US011340547B2

(12) United States Patent
Sato

(10) Patent No.: US 11,340,547 B2
(45) Date of Patent: May 24, 2022

(54) IMAGE FORMING APPARATUS DETECTING FOG DENSITY

(71) Applicant: CANON KABUSHIKI KAISHA, Tokyo (JP)

(72) Inventor: Tomonori Sato, Hamamatsu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/934,348

(22) Filed: Jul. 21, 2020

(65) Prior Publication Data

US 2021/0026284 A1 Jan. 28, 2021

(30) Foreign Application Priority Data

Jul. 22, 2019 (JP) ..... JP2019-134295

(51) Int. Cl.
*G03G 15/08* (2006.01)
*G03G 15/01* (2006.01)
*G03G 15/00* (2006.01)

(52) U.S. Cl.
CPC ..... *G03G 15/556* (2013.01); *G03G 15/0178* (2013.01); *G03G 15/0813* (2013.01); *G03G 15/5062* (2013.01); *G03G 15/0189* (2013.01); *G03G 2215/00067* (2013.01); *G03G 2215/0125* (2013.01); *G03G 2215/0132* (2013.01); *G03G 2215/0465* (2013.01); *G03G 2215/0617* (2013.01)

(58) Field of Classification Search
CPC ..... G03G 15/556; G03G 15/0813; G03G 15/5062; G03G 2215/0617; G03G 2215/00067; G03G 21/1647; G03G 2215/0119; G03G 2215/0125; G03G 2215/0132; G03G 2215/0465; G03G 15/121; G03G 15/0178; G03G 15/0189
See application file for complete search history.

(56) References Cited

U.S. PATENT DOCUMENTS

| | | | | |
|---|---|---|---|---|
| 10,142,515 | B2 | 11/2018 | Nishizawa et al. | |
| 2016/0231665 | A1* | 8/2016 | Shinkawa ..... | G03G 21/0011 |
| 2017/0108809 | A1* | 4/2017 | Itoh ..... | G03G 15/5058 |
| 2017/0244862 | A1* | 8/2017 | Nishizawa ..... | H04N 1/00811 |

FOREIGN PATENT DOCUMENTS

| | | | |
|---|---|---|---|
| JP | 3228056 | B2 | 11/2001 |
| JP | 2017-146487 | A | 8/2017 |
| JP | 2018-112636 | A | 7/2018 |

* cited by examiner

*Primary Examiner* — Walter L Lindsay, Jr.
*Assistant Examiner* — Laura Roth
(74) *Attorney, Agent, or Firm* — Venable LLP

(57) ABSTRACT

An image forming apparatus includes an image bearing member, a developing member, a controller configured to carry out switching control between a first state in which the developing member is caused to act on the image bearing member and a second state in which the developing member is not caused to act on the image bearing member, a transfer member, and a detector configured to read density information of the recording material. The controller detects a fog density on the basis of a difference in density information between a fog non-occurrence region of a non-image region of the recording material in the second state and a fog occurable region of the non-image region of the recording material in the first state.

8 Claims, 11 Drawing Sheets

(a)

(b)

(c)

IMAGE FORMING APPARATUS DETECTING FOG DENSITY

FIELD OF THE INVENTION AND RELATED ART

The present invention relates to an image forming apparatus of an electrophotographic type, such as a copying machine or a printer.

In the image forming apparatus of the electrophotographic type, as a developing device approaches an end of a lifetime thereof, toner deteriorates and charge control of the toner can be gradually carried out with accuracy, so that contamination due to a fog occurs. Here, the fog refers to a phenomenon such that a density of a background of a recording material increases due to deposition of unintended slight toner on a non-image portion where an image is not printed (formed). In the case where a numerical value indicating such a fog increases to a certain value or more, there is a need that a user carries out a process such as exchange of the developing device or the like. In the case where a reverse developing device is not prepared until the process such as the exchange of the developing device is carried out, time loss due to an ordering operation or the like becomes large, and therefore, it is desirable that such loss is reduced by ordering of an exchange component part in advance.

In such a situation, Japanese Patent No. 3228056 discloses an image forming apparatus in which the lifetime of the developing device is predicted from a film thickness of a photosensitive drum and the number of passed sheets and exchange of the developing device is prompted to the user before the contamination due to the fog is recognized by the user. Further, Japanese Laid-Open Patent Application (JP-A) 2017-146487 discloses an image forming apparatus in which an occurrence of an inconvenience and a color for which the inconvenience occurred are discriminated by reading an image on a recording material. Further, JP-A 2018-112636 discloses an image forming apparatus in which a fog density is detected by comparing front and back sides (surfaces) of the recording material on which an image is printed.

Further, the image forming apparatuses in recent years have been required to shorten a first print out time (FPOT) which is a time from a start of printing to completion of discharge of paper (sheet) and to reduce a down time in which the image forming apparatus cannot be operated due to calibration or the like.

However, in Japanese Patent No. 3228056, a problem such that the lifetime is predicted and therefore detection accuracy of the lifetime is inferior to the case where the fog density is directly detected, and a problem such that the down time occurs with the detection of the film thickness of the photosensitive drum arise. Further, in JP-A 2018-112636, a problem such that before the image is printed, the fog density of the recording material with a difference in brightness or the like between the front side and the back side cannot be detected with accuracy arises. Further, in JP-A 2017-146487, a problem such that although as means capable of solving the above-described problem, a method in which paper is manually set at an image reading portion and the image is read is disclosed, a down time occurs in this method arises.

SUMMARY OF THE INVENTION

According to an aspect of the present invention, there is provided an image forming apparatus, comprising: an image bearing member on which an electrostatic latent image is formed; a developing member configured to develop the electrostatic latent image, formed on the image bearing member, into a toner image; a controller configured to carry out switching control between a first state in which the developing member is caused to act on the image bearing member and a second state in which the developing member is not caused to act on the image bearing member; a transfer member configured to transfer the toner image from the image bearing member onto a recording material; and a detector configured to read density information of the recording material carrying the toner image transferred by the transfer member, wherein the controller detects a fog density on the basis of a difference in density information between a fog non-occurrence region of a non-image region of the recording material in the second state and a fog occurable region of the non-image region of the recording material in the first state.

According to another aspect of the present invention, there is provided an image forming apparatus comprising an image bearing member on which an electrostatic latent image is formed; a developing member configured to develop the electrostatic latent image, formed on the image bearing member, into a toner image; a transfer member configured to transfer the toner image from the image bearing member onto a recording material; a controller configured to carry out switching control between a first state in which the transfer member is caused to act on the image bearing member and a second state in which the transfer member is not caused to act on the image bearing member; and a detector configured to read density information of the recording material carrying the toner image transferred by the transfer member, wherein the controller detects a fog density on the basis of a difference in density information between a fog non-occurrence region of a non-image region of the recording material in the second state and a fog occurable region of the non-image region of the recording material in the first state.

Further features of the present invention will become apparent from the following description of exemplary embodiments with reference to the attached drawings.

Figure 3:
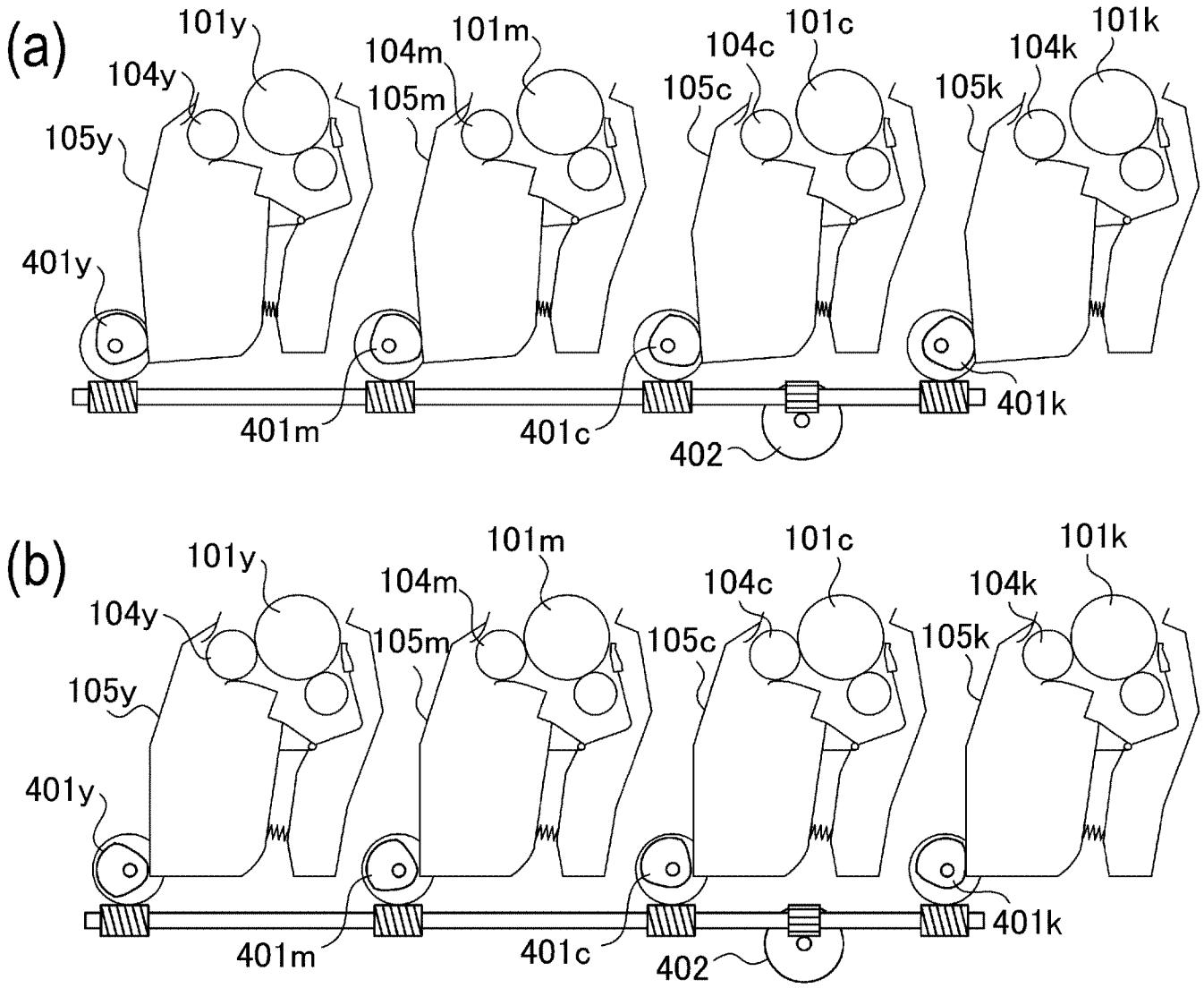

Parts (a) and (b) of FIG. 3 are partially enlarged schematic views of the image forming apparatus according to the embodiment 1.

Figure 4:
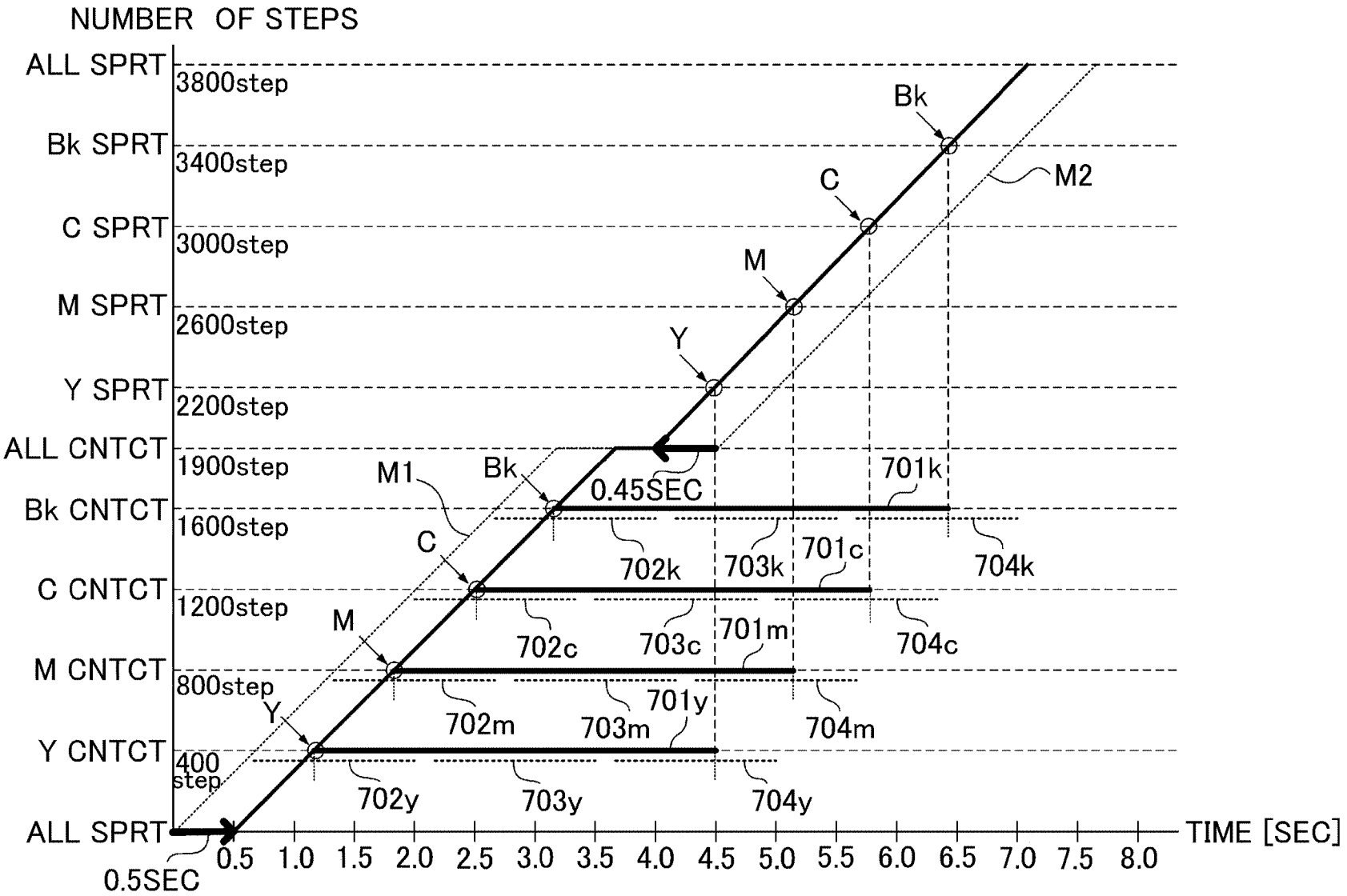

FIG. 4 is a graph showing a relationship between a contact and separation motor and a contact and separation state in the image forming apparatus according to the embodiment 1.

Figure 5:
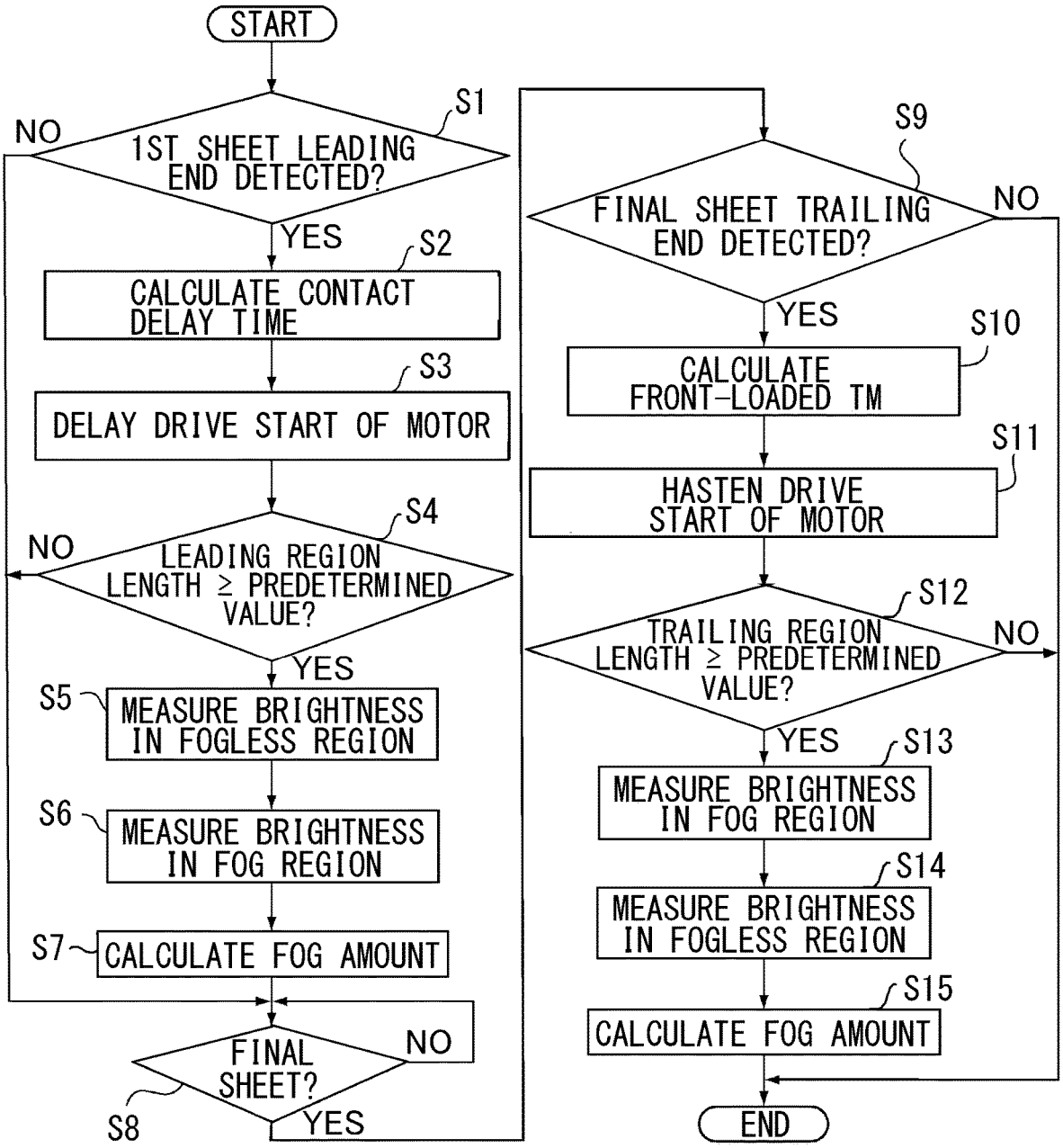

FIG. 5 is a flowchart showing an operation of the image forming apparatus according to the embodiment 1.

Figure 6:
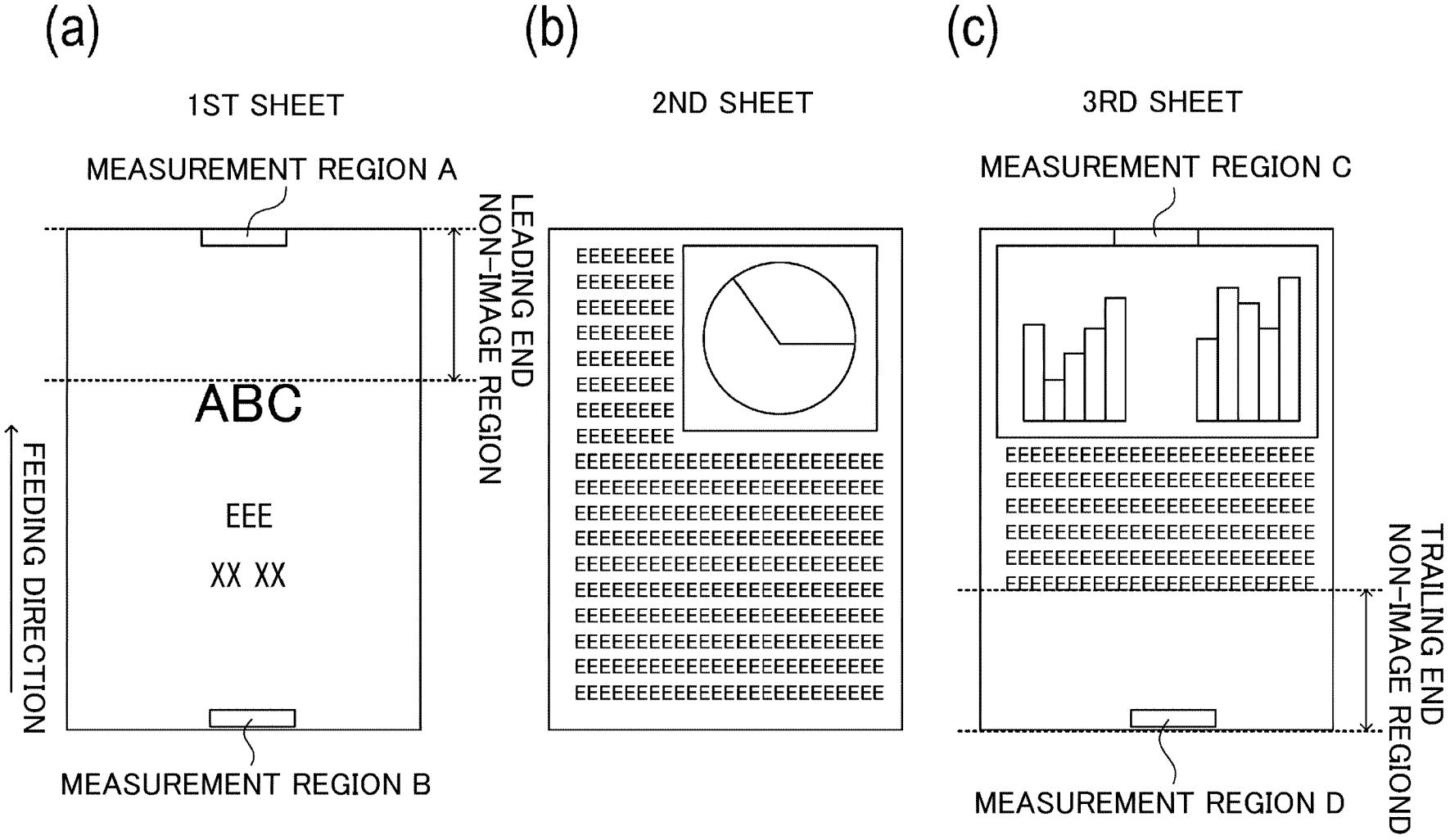

Parts (a) to (c) of FIG. 6 are schematic views each showing an example of a recording material on which an image is formed by the image forming apparatus according to the embodiment 1.

Figure 7:
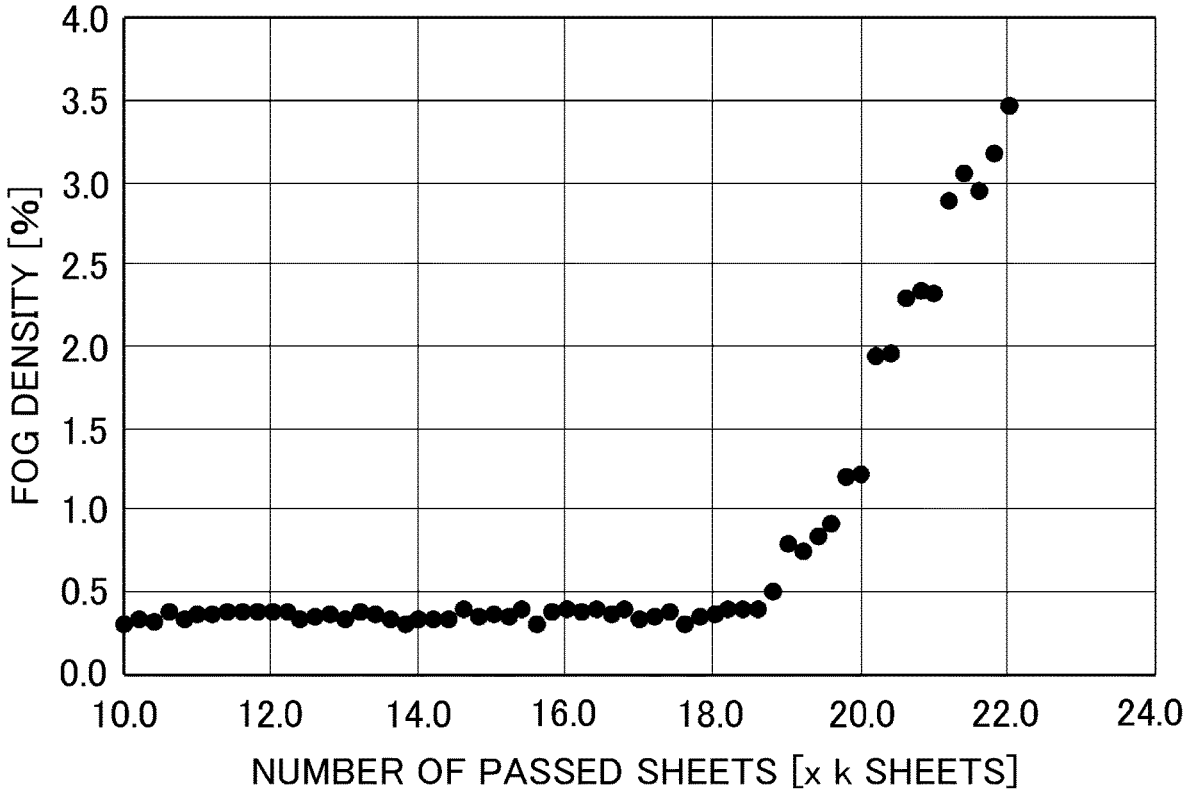

FIG. 7 is a graph showing a relationship between the number of passed sheets and a fog density of the image forming apparatus according to the embodiment 1.

Figure 8:
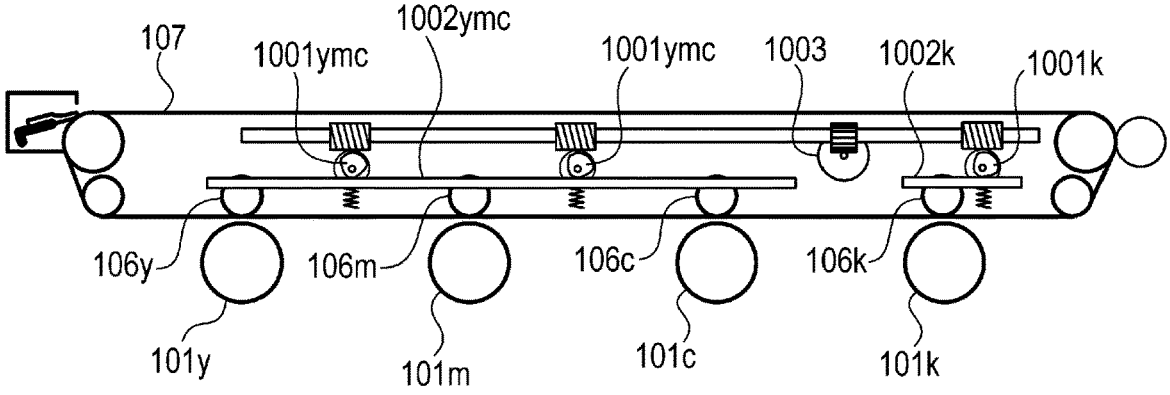
Figure 8:
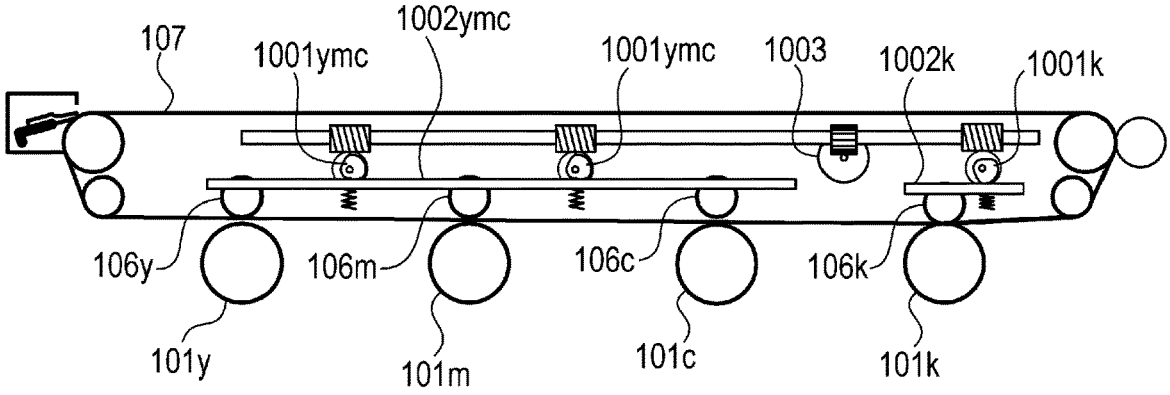
Figure 8:
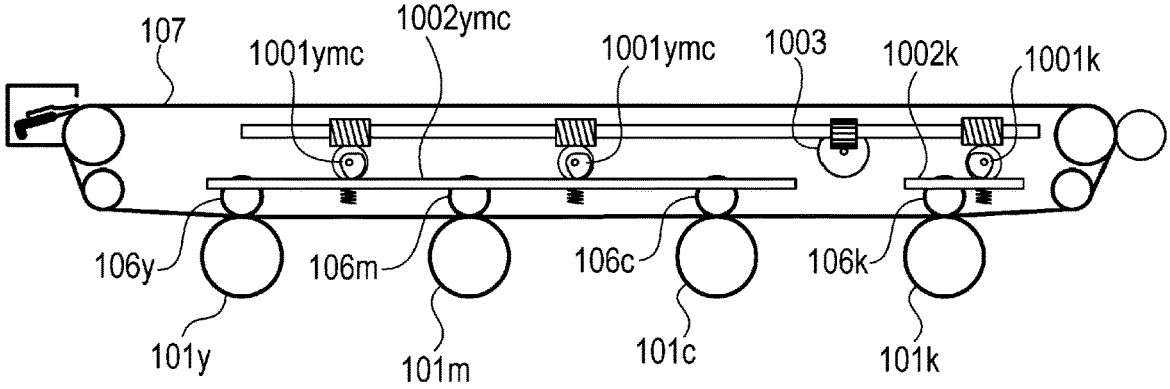

Parts (a) to (c) of FIG. 8 are schematic views of an image forming apparatus according to an embodiment 2.

Figure 9:
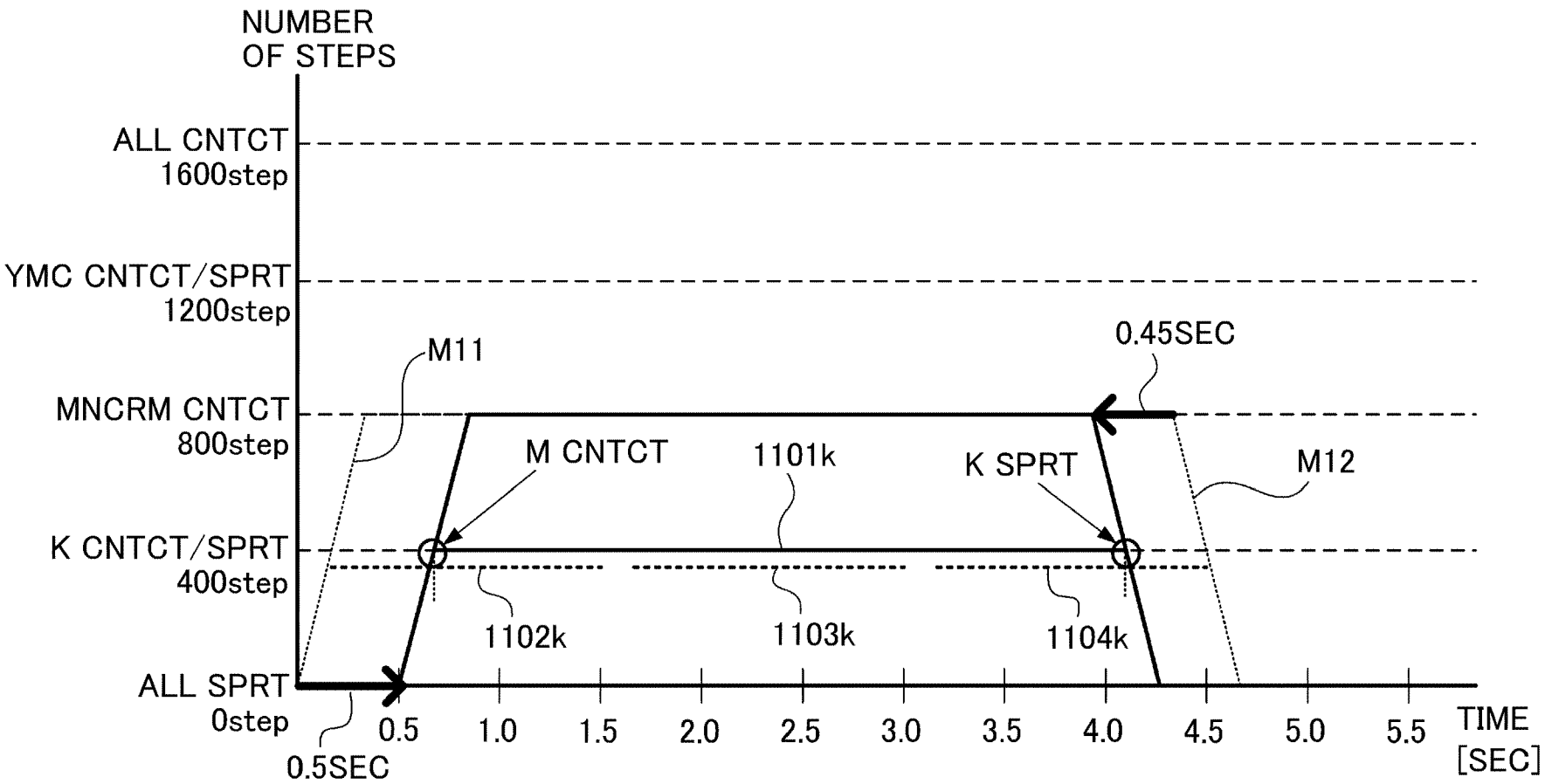

FIG. 9 is a graph showing a relationship between a contact and separation motor and a contact and separation state in the image forming apparatus according to the embodiment 2.

Figure 10:
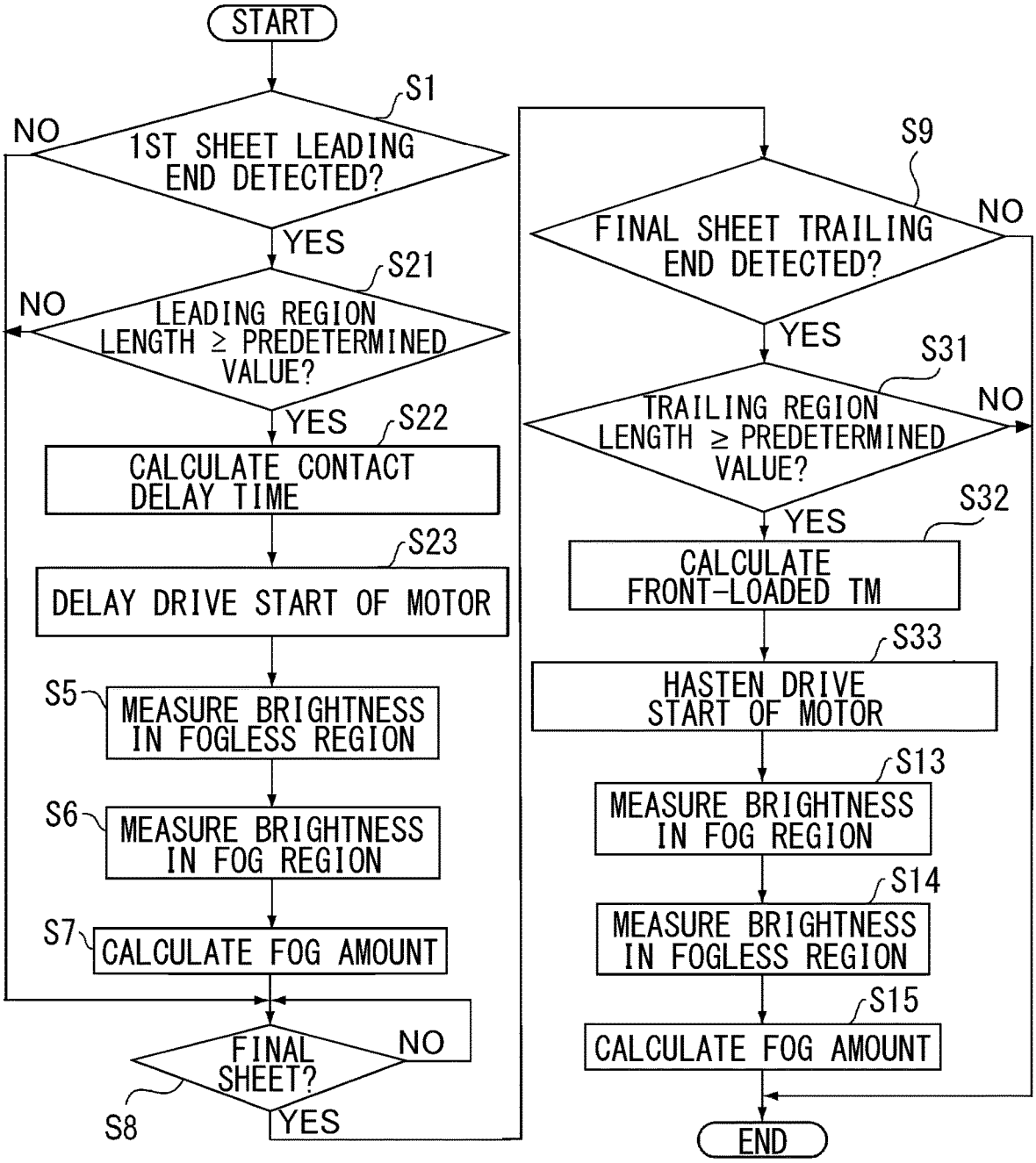

FIG. 10 is a flowchart showing an operation of the image forming apparatus according to a modified embodiment 1.

Figure 11:
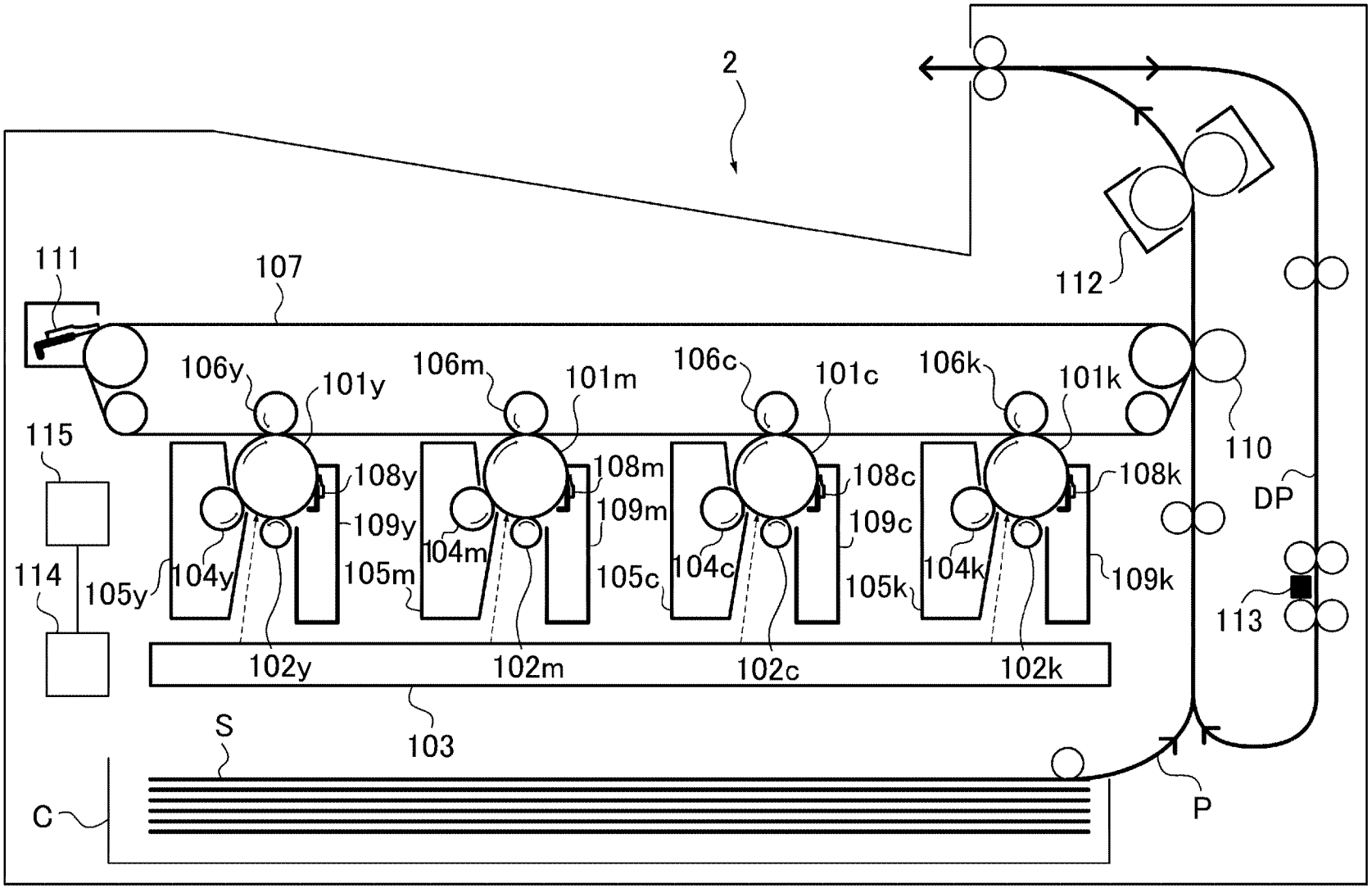

FIG. 11 is a schematic view of an image forming apparatus according to a modified embodiment 2.

DESCRIPTION OF EMBODIMENTS

In the following, embodiments of the present invention will be specifically described with reference to the drawings.

Embodiment 1

In an embodiment 1 of the present invention, a fog non-occurrence region is formed in a non-image region on a recording material by moving a developing means away from an image bearing member, and a fog density is measured from a difference in fog density between a fog occurrence region and a fog non-occurrence region on the recording material.

<Image Forming Apparatus>

Figure 1:
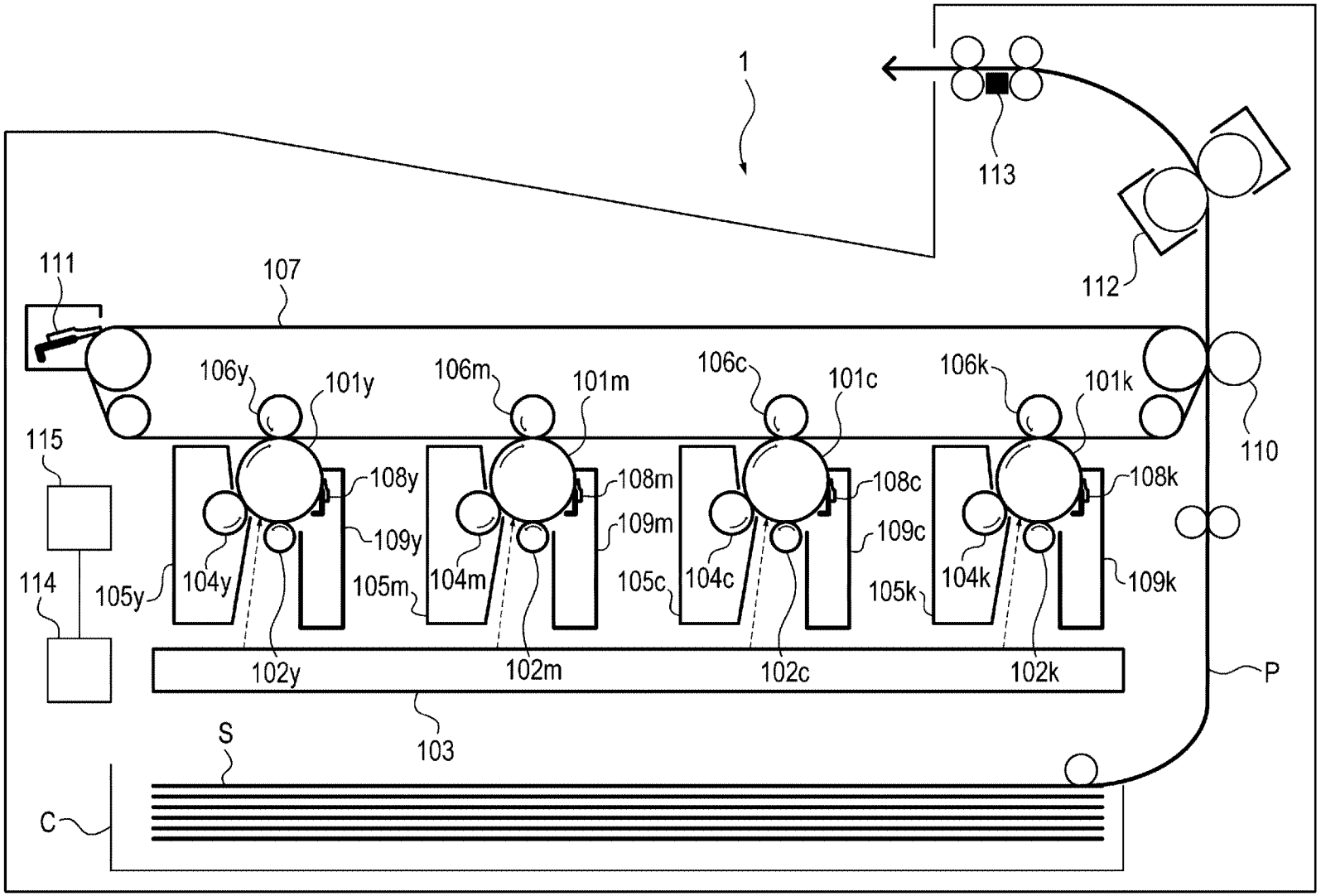
FIG. 1 is a schematic view of an image forming apparatus according to an embodiment 1.
Figure 2:
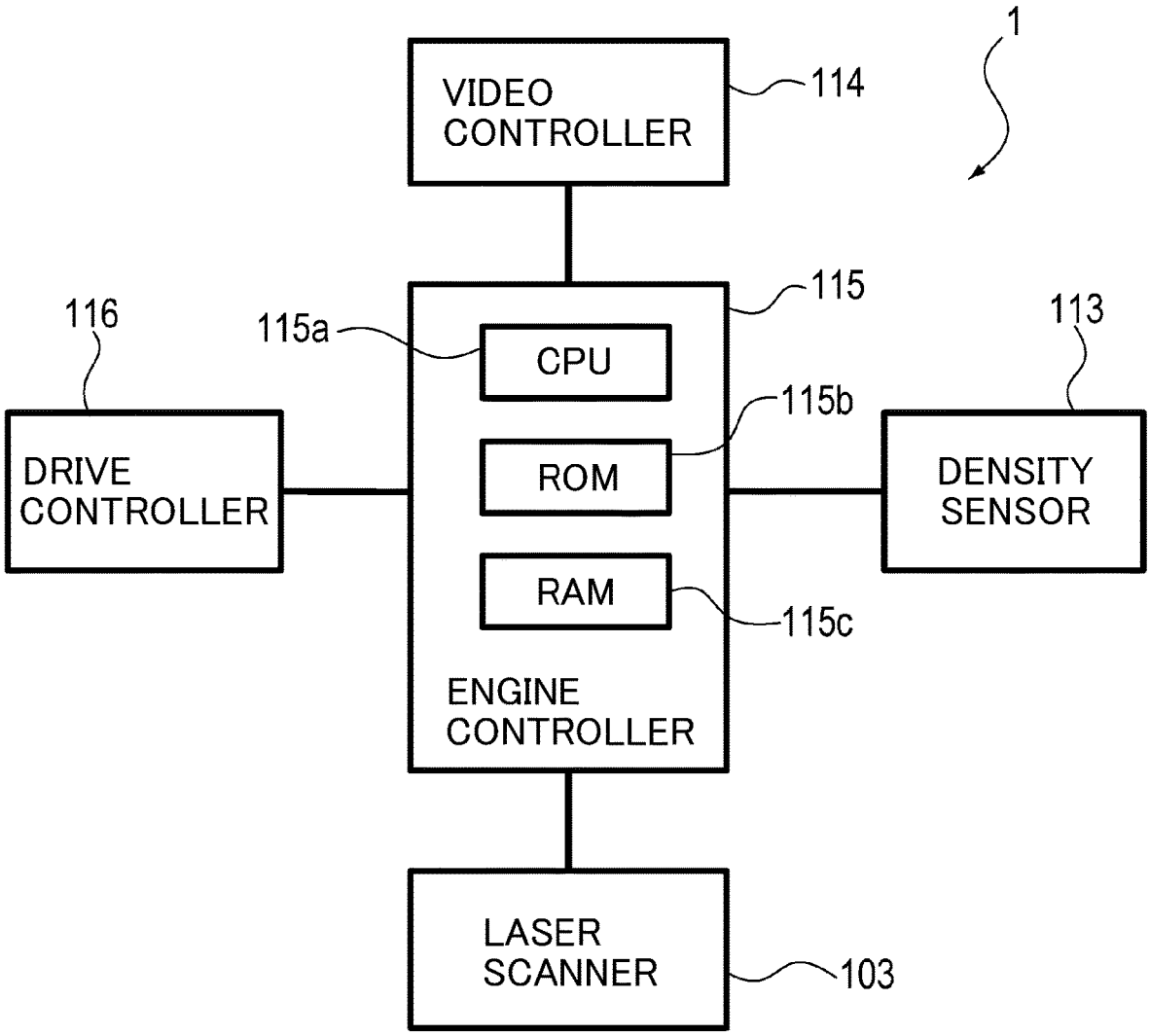
FIG. 2 is a block diagram showing a structure of the image forming apparatus according to the embodiment 1.

A structure of an image forming apparatus 1 according to the embodiment 1 of the present invention will be specifically described while making reference to FIGS. 1 and 2.

The image forming apparatus 1 includes photosensitive drums 101*y*, 101*m*, 101*c* and 101*k*, charging rollers 102*y*, 102*m*, 102*c* and 102*k*, a laser scanner 103, and developing rollers 104*y*, 104*m*, 104*c* and 104*k*. Further, the image forming apparatus 1 includes developing containers 105*y*, 105*m*, 105*c* and 105*k*, primary transfer rollers 106*y*, 106*m*, 106*c* and 106*k*, and an intermediary transfer belt 107.

Further, the image forming apparatus 1 includes cleaning blades 108*y*, 108*m*, 108*c* and 108*k*, residual toner containers 109*y*, 109*m*, 109*c* and 109*k*, a secondary transfer roller 110 and a belt cleaning blade 111. Further, the image forming apparatus 1 includes a fixing device 112, a color sensor 113, a video controller 114, an engine controller 115 and a drive controller 116.

Incidentally, in the following description, as regards reference numerals or symbols such as the photosensitive drums 101*y*, 101*m*, 101*c* and 101*k* provided for colors of y, m, c and k, respectively, for convenience of explanation, the case where, for example, the photosensitive drum is indicated by the photosensitive drum 101 which is represented only by a reference numeral without adding a letter of the alphabet will be included.

Here, the photosensitive drum 101, the charging roller 102, the laser scanner 103, the developing roller 104, the developing container 105 and the primary transfer roller 106 constitute an image forming portion. Further, the photosensitive drum 101, the charging roller 102, the developing roller 104, the developing container 105, the cleaning blade 108 and the residual toner container 109 are collectively called a cartridge (hereinafter referred to as a "CRG"), and the CRG is configured to be capable of being exchanged. Incidentally, a lifetime of the CRG is 2000 sheets.

To the photosensitive drums 101*y*, 101*m*, 101*c* and 101*k* as image bearing members, the charging rollers 102*y*, 102*m*, 102*c* and 102*k* are contacted, respectively. The photosensitive drum 101 is rotatable in a direction shown by an arrow in FIG. 1, by a drive controller 116.

The charging rollers 102*y*, 102*m*, 102*c* and 102*k* electrically charge surfaces of the photosensitive drums 101*y*, 101*m*, 101*c* and 101*k*, respectively, to a uniform potential.

The laser scanner 103 irradiates the charged surface of the photosensitive drum 101 with laser light under control of the CPU 115*a* of the engine controller 115, so that an electrostatic latent image is formed on the photosensitive drum 101.

The developing rollers 104*y*, 104*m*, 104*c* and 104*k* are accommodated in feeding containers 105*y*, 105*m*, 105*c* and 105*k*, respectively. The developing roller 104 develops the electrostatic latent image into a toner image with toner under application of a developing bias to the surface of the photosensitive drum 101.

In the developing container 105, the toner is accommodated.

The primary transfer roller 106 as a transfer means transfers the toner image from the photosensitive drum 101 onto the intermediary transfer belt 107 by applying a transfer bias thereto.

On the intermediary transfer belt 107, a color image is formed by pressing a back surface of the intermediary transfer belt 107 against the photosensitive drum 101 by the primary transfer roller 106.

The cleaning blade 108 removes the toner, by rotation of the photosensitive drum 1, remaining on the surface of the photosensitive drum 101 without being transferred onto the intermediary transfer belt 107.

The residual toner container 109 accommodates the toner removed by the cleaning blade 108 (cleaning operation).

The secondary transfer roller 110 transfers the toner image from the intermediary transfer belt 107 onto the sheet S as a recording material fed from a sheet (paper) feeding cassette C along a feeding passage P.

The belt cleaning blade 111 removes the toner remaining on the surface of the intermediary transfer belt 107 without being transferred by the secondary transfer roller 110.

The fixing device 112 fixes the toner image, as a permanent image, transferred onto the sheet S by the secondary transfer roller 110, on the sheet S.

The color sensor 113 as a density separating means is provided on a side downstream of the fixing device 112 with respect to a feeding direction as a movement direction of the sheet S, and is a CIS (contact image sensor), for example. The color sensor 113 outputs, to the CPU 115*a* of the engine controller 115, information on RGB encoded by 24 bpp (24-bit data per (one) pixel) as density information.

The RGB information is represented by three 8-bit integers (0 to 255), with no symbols, showing brightness of red (R), green (G) and blue (B). Values of each of R, G and B are, for example, black k=(0, 0, 0), yellow y=(255, 255, 0), magenta m=(255, 0, 255), and cyan c=(0, 255, 255).

The color sensor 113 acquires the RGB information with a resolution per 1 mm with respect to the feeding direction and outputs the acquired RGB information corresponding to 5 mm.

The video controller 114 receives image information, margin information indicating a margin region of the sheet S and size information indicating the size of the sheet S. The video controller 114 develops the received pieces of the information, and forms not only position information indicating an image forming position relative to the origin coordinate as a reference position of the sheet S for each color but also a video signal based on the received image information. The video controller 114 outputs, to the engine controller 115, the position information indicating the image forming position, the margin information and the size information together with a reservation command, and thereafter outputs a print start command to the engine controller 115.

The video controller 114 outputs a video signal to the engine controller 115 when a TOP signal is inputted from the engine controller 115. Here, the TOP signal corresponds to a vertical synchronizing signal between the video controller 114 and the engine controller 115 and constitutes a trigger for outputting a video signal per page from the video controller 114 to the engine controller 115.

Further, output timing of the TOP signal constitutes basis for starting irradiation of the photosensitive drum 101 with laser light from the laser scanner 103. In actuality, the laser (light) irradiation is started after a lapse of a time, from timing when the TOP signal is outputted, of movement of the photosensitive drum 101 along a rotational direction by a length of a marginal region. As regards, the TOP signal, assuming that the laser irradiation is performed at that time, a position-to-be-irradiated with laser light on the photosensitive drum 101 corresponds to a leading end/edge portion position of the sheet S with respect to the rotational direction of the photosensitive drum 101. That is, the position-to-be-irradiated with laser light on the photosensitive drum 101 when the laser irradiation is performed at the output timing of the TOP signal corresponds to the leading end/edge portion position of the sheet S with respect to the rotational direction of the photosensitive drum 101.

The engine controller 115 as a control means includes the CPU 115*a*, a ROM 115*b* and a RAM 115*c*. The CPU 115*a* operates while using the RAM 115*c* in accordance with a control program stored in the ROM 115*b*.

The CPU 115*a* awaits input of a print start command when the reservation command is inputted from the video controller 114, and starts an image formation preparation operation by starting a pre-rotation sequence when the print start command is inputted from the video controller 114. The CPU 115*a* controls an operation of the drive controller 116 in the image formation preparation operation and carries out various processes, such as a process of applying the charging bias to the charging roller 102, except for a process of driving the developing roller 104 so as to contact the photosensitive drum 101. The CPU 115*a* outputs the TOP signal to the video controller 114 when the image formation preparation operation is completed.

The CPU 115*a* controls the operation of the drive controller 116 on the basis of the output timing of the TOP signal to the video controller 114, and thus drives the developing roller 114. Specifically, the CPU 115*a* carries out switching control from a first state in which the developing roller 104 is moved away from the photosensitive drum 101 and is prevented from acting on the photosensitive drum 1 to a second state in which the developing roller 104 is contacted to the photosensitive drum 101 and is caused to act on the photosensitive drum 101, or carries out switching control opposite from this switching control.

The CPU 115*a* controls operations of the laser scanner 103 and the drive controller 116 on the basis of position information, margin information, size information and the video signal which are inputted from the video controller 114, so that the image is formed on the sheet S.

The CPU 115*a* detects a fog density on the basis of a measured value inputted from the color sensor 113 when the image is formed on the sheet S. Specifically, the CPU 115*a* acquires, as the measured value, an average of values, of R, G and B corresponding to 5 mm, inputted from the color sensor 113, and then calculates brightness L by this measured value. A calculation formula for calculating the brightness L from such RGB information is, for example, the following formula (1).

$$L=(0.3R+0.59G+0.11B)/2.55 \quad (1)$$

Here, in the formula (1), the respective numerical values 0.3, 0.59 and 0.11 by which the R, G and B are multiplied, respectively, are values of coefficients as fixed values preset for acquiring the brightness L, and are stored in the ROM 115*b* in advance.

The CPU 115*a* detects the fog density on the basis of a calculation result of the brightness L.

The CPU 115*a* presses a lifetime of the developing roller 104 on the basis of the detected fog density, and when the CPU 115*a* discriminated that a process such as exchange or the like of the developing roller 104 is needed, the CPU 115*a* prompts a user to perform the process such as the exchange or the like of the developing roller 104 by displaying a message to that effect on an unshown display portion. For example, when the fog density is a predetermined value or more, the CPU 115*a* prompts the user to perform the process such as the exchange or the like of the developing roller 104.

The ROM 115*b* stores the control program in advance.

The RAM 115*c* is a work memory.

The drive controller 116 is operated by control of the CPU 115*a*, and causes the photosensitive drum 101, the charging roller 102, the developing roller 104, the primary transfer roller 106, the intermediary transfer belt 107, the secondary transfer roller 110 and the fixing device 112 and the like to drive.

<Contact and Separation Mechanism for Developing Roller>

A contact and separation mechanism for the developing roller 104 of the image forming apparatus 1 according to the embodiment 1 of the present invention will be specifically described with reference to FIGS. 3 and 4.

Part (a) of FIG. 3 shows a stand-by state in which cams 401*y*, 401*m*, 401*c* and 401*k* press side surfaces of the developing containers 105*y*, 105*m*, 105*c* and 105*k*, respectively, with maximum diameters thereof and thus all the developing rollers 104 and all the photosensitive drums 101 are separated from each other. Further, part (b) of FIG. 3 shows a contact state in which the pressing of each of the cams 401*y*, 401*m*, 401*c* and 401*k* against the side surface of an associated one of the developing containers 105*y*, 105*m*, 105*c* and 105*k* is released and thus all the developing rollers 104 and all the photosensitive drums 101 are in contact with each other.

Further, in FIG. 4, each of bold lines 701*y*, 701*m*, 701*c* and 701*k* represents the contact state between the photosensitive drum 101 and the developing roller 104 for an associated one of the colors. Further, each of broken lines 702*y*, 702*m*, 702*c* and 702*k* represents a position corresponding to a first sheet S for the associated one of the colors. Further, each of broken lines 703*y*, 703*m*, 703*c* and 703*k* represents a position corresponding to a second sheet S for the associated one of the colors. Further, each of broken lines 704*y*, 704*m*, 704*c* and 704*k* represents a position corresponding to a third sheet S for the associated one of the colors. Incidentally, FIG. 4 shows an example of the case where images are formed on three A4-size sheets.

The maximum diameter position of each of the cams 401*y*, 401*m*, 401*c* and 401*k* is deviated in phase in the clockwise direction in the order of the cams 401*y*, 401*m*, 401*c* and 401*k* in FIG. 3. Further, a contact operation or a separation operation between the photosensitive drum 101 and the developing roller 104 is carried out by driving contact and separation motor 402 under switching control of the drive controller 116 by the CPU 115*a*.

In the case where the state is changed from the stand-by state to the contact state, in the stand-by state of part (a) of FIG. 3, when the contact and separation motor 402 is rotated by the drive controller 116, each of the cams 401*y*, 401*m*, 401*c* and 401*k* is rotated in the counterclockwise direction in part (a) of FIG. 3. Then, first, the cam 401*y* releases the pressing of the side surface of the developing container 105*y*. Then, in accordance with the phase deviation, the pressing of the side surfaces of the developing containers 105*m*, 105*c* and 105*k* is released in the order of the cams 401*m*, 401*c* and 401*k*. By this, from the stand-by state of part (a) of FIG. 3, the developing roller 104 and the photosensitive drum 101 are successively contacted to each other in the order of those of the yellow y, the magenta m, the cyan c and the black k, so that the state is changed to a full-color contact state (all contact state).

Specifically, from FIG. 4, in the case where an all separation position is established in 0 step in terms of the number of steps for the contact and separation motor 402, in a 400-th step, the photosensitive drum 101*y* and the developing roller 104*y* contact each other. In an 800-th step, the photosensitive drum 101*m* and the developing roller 104*m* contact each other, in a 1200-th step, the photosensitive drum 101*c* and the developing roller 104*c* contact each other, and in a 1600-th step, the photosensitive drum 101*k* and the developing roller 104*k* contact each other. In a 1900-th step after the photosensitive drums 101 for all the colors and the developing rollers 104 for all the colors contact each other, drive of the contact and separation motor 402 is stopped, so that the contact state between all the photosensitive drums 101 and all the developing rollers 104 are maintained.

Further, when the state is changed from the contact state, in which the contact between all the photosensitive drums 101 and all the developing roller 104 is maintained, to the stand-by state, the drive of the contact and separation motor 402 is resumed so that the photosensitive drums 101 and the developing rollers 104 are separated from each other during feeding of a third sheet S. By rotating the contact and separation motor 402, the cams 401*y*, 401*m*, 401*c* and 401*k* press the side surfaces of the developing containers 105*y*, 105*m*, 105*c* and 105*k*, respectively, in the named order. By this, in the order of the yellow y, the magenta m, the cyan c and the black k, the developing rollers 104*y*, 104*m*, 104*c* and 104*k* and the photosensitive drums 101*y*, 101*m*, 101*c* and 101*k* are separated from each other, respectively.

Specifically, from FIG. 4, in a 2200-th step of the contact and separation motor 402, the photosensitive drum 101*y* and the developing roller 104*y* are separated from each other. In a 2600-th step, the photosensitive drum 101*m* and the developing roller 104*m* are separated from each other, in a 3000-th step, the photosensitive drum 101*c* and the developing roller 104*c* are separated from each other, and in a 3400-th step, the photosensitive drum 101*k* and the developing roller 104*k* are separated from each other. In a 3800-th step after the photosensitive drums 101 for all the colors and the developing rollers 104 for all the colors are separated from each other, drive of the contact and separation motor 402 is stopped, so that the separated state between all the photosensitive drums 101 and all the developing rollers 104 are maintained.

Thus, by controlling the contact and separation motor 402, it is possible to control the contact state in which the developing rollers 104*y*, 104*m*, 104*c* and 104*k* act on the photosensitive drums 101*y*, 101*m*, 101*c* and 101*k* and the separated state in which the developing rollers 104*y*, 104*m*, 104*c* and 104*k* do not act on the photosensitive drums 101*y*, 101*m*, 101*c* and 101*k*.

<Operation of Image Forming Apparatus>

An operation of the image forming apparatus 1 according to the embodiment of the present invention will be described specifically with reference to FIGS. 4 to 7.

Parts (a) to (c) of FIG. 6 are schematic views showing the case where images are formed on a plurality of sheets S. Part (a) of FIG. 6 shows a first sheet S on which the image has already been formed. Part (b) of FIG. 6 shows a second sheet S on which the image has already been formed. Part (c) of FIG. 6 shows a third sheet S on which the image has already been formed.

FIGS. 4 to 6 illustrate the case where when the images are formed on three A4-size sheets S, not only a leading end non-image region is formed on the first sheet S shown in part (a) of FIG. 6 but also a trailing end non-image region is formed on the third sheet S.

In this embodiment, contact timing between the photosensitive drum 101 and the developing roller 104 is delayed depending on a length of the leading end non-image region of the first sheet S or separation timing between the photosensitive drum 101 and the developing roller 104 is advanced depending on a length of the trailing end non-image region of the final sheet S. By this, fog does not occur as long as the developing roller 104 does not contact the photosensitive drum 101, and therefore, it is possible to form a fog non-occurrence region and a fog occurable region on the same surface of the sheet S. In this embodiment, a fog density is detected from a density difference (density information difference) between the fog non-occurrence region and the fog occurable region.

The image forming apparatus 1 starts an operation shown in FIG. 5 by turning on an unshown main power source and then by receiving image information or the like from an unshown host computer.

First, the CPU 115*a* discriminates whether or not the leading end non-image region is detected, on the basis of a position which is indicated by positional information inputted from the video controller 114 and where formation of the image on the first sheet S is started (S1). Here, the leading end non-image region is, as shown in part (a) of FIG. 6, a region continuous from the leading end (edge portion) toward the trailing end side of the sheet S with respect to the feeding direction, and is a region in which the image is not formed and which includes a marginal region.

In the case where the leading end non-image region of the first sheet S is detected (S1: YES), the CPU 115*a* acquires a length of the leading end non-image region with respect to the feeding direction (hereinafter referred to as a "leading end non-image region length") for each of the colors. Specifically, the CPU 115*a* acquires the leading end non-image region length for each color from an origin coordinate indicating a leading end position (most upstream position) on the sheet S with respect to the sheet feeding direction and a positional coordinate which is indicated by positional information and where the image formation is started. For example, in the case where the origin coordinate is (0, 0) and the positional coordinate where the image formation is started is (x1, y1), the CPU 115*a* acquires a length y1 of the leading end non-image region.

Then, the CPU 115*a* calculates a contact delay time from a preset feeding speed and a shortest length of the acquired leading end non-image region lengths for each color (S2). For example, in the case where the shortest length of the leading end non-image region is 100 mm and the feeding speed of the sheet S is 200 mm/sec, the CPU 115*a* acquires the contact delay time of 100 [mm]/200 [mm/sec]=0.5 [sec] by calculation.

Then, the CPU 115*a* delays a start of drive of the contact and separation motor 402 on the basis of the acquired contact delay time (S3).

Specifically, the CPU 115*a* acquires a rotation time by dividing a length of an outer periphery from a laser irradiation position of the photosensitive drum 101 to a position of the photosensitive drum 101 contacting the developing roller 104 with respect to a rotational direction, by a rotational speed of the photosensitive drum 101. Then, the CPU 115*a* carries out calculation of a formula (2) below for acquiring an addition delay time obtained by adding the acquired rotation time and the contact delay time. Further, in order to cause the developing roller 101 to contact the photosensitive drum 101 somewhat early, a value obtained by subtracting a predetermined time of, for example, 0.1 sec from the addition delay time or the contact delay time is used.

$$\text{Addition delay time} = \text{Contact delay time} + \text{Rotation time} \quad (2)$$

Then, the CPU 115*a* causes the contact and separation motor 402 to start drive after a lapse of the addition delay time from output timing of the TOP signal for the first sheet S, so that the developing roller 104 is contacted to the photosensitive drum 101. The output timing of the TOP signal is reference timing when irradiation of the surface of the photosensitive drum 101*y*, on which the electrostatic latent image is formed earliest, with laser light from the laser scanner 103 occurs. The output timing of the TOP signal corresponds to the origin coordinate, and after the TOP signal is output, surface movement of the photosensitive drum 101 corresponding to a marginal length indicated by margin information is made and then the laser irradiation is capable of being started.

By this, the contact start timing between the photosensitive drum 101*y* and the developing roller 104*y* is delayed from the output timing of the TOP signal for the first sheet by the addition delay time. Thus, even when in the leading end non-image region, the drive start timing of the contact and separation motor 402 is delayed, by a time corresponding to the addition delay time, an image defect does not occur.

For example, the drive start of the contact and separation motor 402 is delayed by 0.5 sec, whereby as shown in FIG. 4, the contact start timing between the photosensitive drum 101 and the developing roller 104 for each color is delayed 0.5 sec longer than timing M2 in the case where the drive start timing is not delayed.

Specifically, the contact between the photosensitive drum 101*y* and the developing roller 104*y* for the yellow y is started from an intermediate position of a broken line 702*y* corresponding to the first sheet S. Further, the contact between the photosensitive drum 101*m* and the developing roller 104*m* for the magenta m is started from an intermediate position of a broken line 702*m* corresponding to the first sheet S. Further, the contact between the photosensitive drum 101*c* and the developing roller 104*c* for the cyan c is started from an intermediate position of a broken line 702*c* corresponding to the first sheet S. Further, the contact between the photosensitive drum 101*k* and the developing roller 104*k* for the black k is started from an intermediate position of a broken line 702*k* corresponding to the first sheet S.

As a result, the leading end non-image region is the fog non-occurrence region, and a non-image region other than the leading end non-image region of the sheet S is the fog occurable region.

Then, the CPU 115*a* discriminated whether or not a shortest length of the leading end non-image region lengths acquired by the video controller 114 is not less than a predetermined value as a threshold (S4).

In the case where the shortest length of the leading end non-image region lengths is not less than the predetermined value (S4: YES), the CPU 115*a* causes the color sensor 113 to measure brightness of the fog non-occurrence region where the fog does not occur (S5). Specifically, for measurement by the color sensor 113, a length of 5 mm or more is needed. Accordingly, in the case where the leading end non-image region length is 5 mm or more, a measurement region A in part (b) of FIG. 6 is used as the fog non-occurrence region, and the CPU 115*a* causes the color sensor 113 to measure brightness L of the measurement region A. The brightness L of the fog non-occurrence region is 93.5, for example.

Then, the CPU 115*a* causes the color sensor 113 to measure the brightness of the fog occurable region (fog occurrence region) in the non-image region (S6). Specifically, a measurement region B in the non-image region other than the leading end non-image region of the first sheet S of part (a) of FIG. 6 is used as the fog occurable region, and the CPU 115*a* causes the color sensor 113 to measure the brightness L of the measurement region B. The brightness L of the fog occurable region is 93.1, for example.

Then, the CPU 115*a* calculates the fog density from measurement results of the steps S5 and S6 (S7). Specifically, the CPU 115*a* calculates, for example, 93.5−93.1=0.4 as the fog density. Thus, the fog density is acquired by a difference between the brightness L of the fog non-occurrence region and the brightness L of the fog occurable region.

On the other hand, in the case where the shortest length of the leading end non-image region lengths is less than the predetermined value (S4: NO), the operation from the step S5 to the step S7 is skipped. Specifically, in the case where the leading end non-image region length is less than 5 mm, the CPU 115*a* skips the operation from the step S5 to the step S7.

Further, in the case where the leading end non-image region of the first sheet S is not detected (S1: NO), the CPU 115*a* skips the operation from the step S2 to the step S7.

Then, the CPU 115*a* discriminates whether or not the video controller 114 receives an image formation instruction for the final sheet S from the unshown host computer (S8).

The CPU 115*a* repeats the operation of the step S8 in the case where the image formation instruction for the final sheet S is not received (S8: NO).

On the other hand, on the basis of a position which is indicated by the positional information inputted from the video controller 114 and where formation of the image on the final sheet S is ended, the CPU 115*a* discriminates whether or not the trailing end non-image region is detected (S9). Here, the trailing end non-image region is, as shown in part (c) of FIG. 6, a region continuous from the trailing end toward the leading end side of the sheet S with respect to the feeding direction, and is a region in which the image is not formed and which includes a marginal region.

In the case where the trailing end non-image region is not detected (S9: NO), the CPU 115*a* ends the operation.

On the other hand, the case where the trailing end non-image region is detected (S9: YES), the CPU 115*a* acquires a length of the trailing end non-image region with respect to the feeding direction (hereinafter referred to as a "trailing end non-image region length") for each of the colors. Specifically, the CPU 115*a* acquires the trailing end non-image region length for each color from a positional coordinate which is indicated by positional information and where the image formation is ended and a terminal coordinate indicating a trailing end position relative to the origin coordinate with respect to the sheet feeding direction. For example, in the case where the terminal coordinate is (X0, Y0) and the positional coordinate where the image formation is ended is (x2, y2), the CPU 115*a* acquires an absolute value (|Y0−y2|) of the trailing end non-image region length.

Then, the CPU 115*a* calculates a separation front-loaded time from a preset feeding speed and a shortest length of the acquired trailing end non-image region lengths for each color (S10). For example, in the case where the shortest length of the trailing end non-image region is 90 mm and the feeding speed of the sheet S is 200 mm/sec, the CPU 115*a* acquires the separation front-loaded time of 90 [mm]/200 [mm/sec]=0.45 [sec] by calculation.

Then, the CPU 115*a* hastens a start of drive of the contact and separation motor 402 on the basis of the acquired separation front-loaded time (S11).

Specifically, the CPU 115*a* acquires a rotation time by dividing a length of an outer periphery from a laser irradiation position of the photosensitive drum 101 to a position of the photosensitive drum 101 contacting the developing roller 104 with respect to a rotational direction, by a rotational speed of the photosensitive drum 101. Further, the CPU 115*a* acquires a distance from the origin coordinate to the terminal coordinate of the final sheet, and by dividing the acquired distance by the feeding speed, the CPU 115*a* acquires an image formation time required for image formation from the origin coordinate to the terminal coordinate of the final coordinate. Further, the CPU 115*a* acquires an addition formation time by adding a rotation time to the acquired image formation time. Incidentally, the addition formation time is a preset value, and therefore, a result calculated in advance is stored in the ROM 115*b*, and the CPU 115*a* may also appropriately make reference to the calculated result at necessary timing.

Then, the CPU 115*a* causes the contact and separation motor 402 to start the drive at timing earlier by the separation front-loaded time than a lapse of the addition formation time from output timing of the TOP signal for the final sheet S. The drive of the contact and separation motor 402 in this case means that the developing roller 104 is separated from the photosensitive drum 101.

By this, separation start timing between the photosensitive drum 101*y* and the developing roller 104*y* is earlier by the separation front-loaded time than a lapse of the addition formation time from the output timing of the TOP signal for the final sheet S (the case where the contact timing of the developing roller 104 is not moved up). Thus, even when in the trailing end non-image region, the drive start timing of the contact and separation motor 402 is moved up by a time corresponding to the separation front-loaded time, an image defect does not occur.

For example, the drive start of the contact and separation motor 402 is moved up by 0.45 sec, whereby as shown in FIG. 4, the separation start timing between the photosensitive drum 101 and the developing roller 104 for each color is delayed 0.45 sec longer than timing M2 in the case where the drive start timing is not moved up.

Specifically, the separation between the photosensitive drum 101*y* and the developing roller 104*y* for the yellow y is started from an intermediate position of a broken line 704*y* corresponding to the third sheet S. Further, the separation between the photosensitive drum 101*m* and the developing roller 104*m* for the magenta m is started from an intermediate position of a broken line 704*m* corresponding to the third sheet S. Further, the separation between the photosensitive drum 101*c* and the developing roller 104*c* for the cyan c is started from an intermediate position of a broken line 704*c* corresponding to the third sheet S. Further, the separation between the photosensitive drum 101*k* and the developing roller 104*k* for the black k is started from an intermediate position of a broken line 704*k* corresponding to the third sheet S.

As a result, the trailing end non-image region is the fog non-occurrence region, and a non-image region other than the trailing end non-image region of the sheet S is the fog occurable region for each color.

Then, the CPU 115*a* discriminated whether or not the trailing end non-image region length acquired by the video controller 114 is not less than a predetermined value as a threshold (S12). For example, in the case where the terminal coordinate is (X0, Y0) and a coordinate of a position where the image formation is ended is (x2, y2), the CPU 115*a* discriminates whether or not an absolute value (|Y0−y2|) is not less than a predetermined value.

In the case where the trailing end non-image region length is not less than the predetermined value (S12: YES), the CPU 115*a* causes the color sensor 113 to measure brightness of the fog occurable region in the non-image region (S13). Specifically, the CPU 115*a* causes the color sensor 113 to measure the brightness L of a measurement region C, as the fog occurable region, of the non-image region other than the trailing end non-image region of the third sheet of part (c) of FIG. 6. The brightness L of the fog occurable region is 93.5, for example.

Then, the CPU 115*a* causes the color sensor 113 to measure the brightness of the fog non-occurrence region (S14). Specifically, for measurement by the color sensor 113, a length of 5 mm or more is needed. Accordingly, in the case where the trailing end non-image region length is 5 mm or more, a measurement region D in part (c) of FIG. 6 is used as the fog non-occurrence region, and the CPU 115*a* causes the color sensor 113 to measure brightness L of the measurement region D. The brightness L of the fog non-occurrence region is 93.2, for example.

Then, the CPU 115*a* calculates the fog density from measurement results of the steps S13 and S14 (S15). Specifically, the CPU 115*a* calculates, for example, 93.5−93.2=0.3 as the fog density.

On the other hand, in the case where the trailing end non-image region length is less than the predetermined value (S12: NO), the operation is ended. Specifically, in the case where the trailing end non-image region length is less than 5 mm, the CPU 115*a* ends the operation.

FIG. 7 is a graph in which a fog density detected by the above-described operation is plotted against the total number of passed sheets. Further, FIG. 7 shows the case where as regards the CRGs for the yellow y, the magenta m and the black k, fresh CRGs were used and as regards only the CRG for the cyan c, a CRG which was used for image formation of 10,000 sheets was used and where a sheet passing test was continued until 22,000 sheets exceeding an end of a lifetime of the CRG for the cyan c were passed.

Identification of the color for which the fog occurred can be discriminated from a distribution of each of values of R, G and B in information on RGB. For example, in the case where the fog occurs due to the lifetime, a change in value of the R in the information on RGB occurs. In FIG. 7, the fog density increases from the neighborhood of 19,000 sheets close to the end of the lifetime of the CRG for the cyan c. Incidentally, the fog density at the time of 19,000 sheets is 0.8.

At this time, a distribution of values of R, G and B in the fog non-occurrence region was (239, 238, 239), and a distribution of values of R, G and B in the fog occurable region was (230, 239, 239). As a result of comparison of these values, a decrease in brightness is caused due to a decrease in value of R, and therefore, the distribution of each of the values of R, G and B from the neighborhood of 19,000 sheets can be discriminated as a distribution due to the end of the lifetime of the CRG for the cyan c. Therefore, in this embodiment, when an increase in fog density is detected, a factor of the decrease in brightness can be discriminated as being the end of the lifetime of the CRG for the cyan c, and therefore, it is possible to notify a user that the developing roller 104*c* for the cyan c approaches the end of the lifetime thereof.

Thus, according to this embodiment, by controlling actuation timing of the contact and separation motor 402, it becomes possible to detect the fog density in an image forming operation time, and therefore, the fog density can be detected without generating a downtime. On the other hand, in order to detect the fog density on the same surface of the sheet S, a particular operation of the user was needed.

Further, according to this embodiment, the fog density is detected on the same surface of the sheet S, so that even when the sheet S causes a difference in brightness or the like between the front and back sides (surfaces), the fog density can be accurately detected without generating the downtime such as a delay of the FPOT.

In this embodiment, in the image forming apparatus, it is desirable that the increase in fog density is detected within a range in which the user does not recognize the fog and the user is notified of the end of the lifetime of the ORG. According to an experimental result of this embodiment, when the fog density exceeds 3.0, a user recognition rate starts to increase, and therefore, when the fog density of the CRG increases up to a predetermined value of less than 3.0, the image forming apparatus 1 may preferably notify the user of the end of the lifetime of the CRG.

In this embodiment, the fog non-occurrence region is formed in the non-image region of the sheet by carrying out control so that the developing roller 104 does not act on the photosensitive drum 101. Further, the fog occurable region is formed in the non-image region of the sheet by carrying out control so that the developing roller 104 acts on the photosensitive drum 101. Then on the basis of a difference in density information between the fog non-occurrence region and the fog occurable region, the fog density is detected. By this, it is possible to accurately detect the fog density without generating the downtime.

Incidentally, in this embodiment, the image forming apparatus in which the image is transferred onto the sheet S through the intermediary transfer belt 7 was used, but a color image forming apparatus or a monochromatic image forming apparatus in which the image is directly transferred onto the sheet S may also be used.

Embodiment 2

In an embodiment 2 of the present invention, a fog non-occurrence region is formed in a non-image region on a recording material by moving a transfer means away from an image bearing member, and a fog density is measured from a difference in fog density between a fog occurrence region and a fog non-occurrence region on the recording material.

Incidentally, a general structure of an image forming apparatus according to this embodiment is the same as the general structure of the image forming apparatus shown in FIGS. 1 and 2, and therefore will be omitted from description.

<Contact and Separation Mechanism for Primary Transfer Roller>

A contact and separation mechanism for the primary transfer roller 106 of an image forming apparatus 1 according to an embodiment 2 of the present invention will be specifically described with reference to FIGS. 8 and 9.

Part (a) of FIG. 8 shows a stand-by state in which all the primary transfer rollers 106 are separated from all the photosensitive drums 101 through the intermediary transfer belt 107 by releasing (eliminating) pressing of transfer roller pressing members 1002*ymc* and 1002*k* by cams 1001*ymc* and 1001*k*, respectively. Part (b) of FIG. 8 shows a monochromatic contact state in which only the primary transfer roller 106*k* contacts the intermediary transfer belt 107 toward the photosensitive drum 101*k* by pressing the pressing member 1002*k* with a maximum diameter. Part (c) of FIG. 8 shows a full-color contact state in which all the primary transfer rollers 106 contact the intermediary transfer belt 107 toward all the photosensitive drums 101 by pressing the transfer member pressing members 1002*ymc* and 1002*k* by the cams 1001*ymc* and 1001*k*, respectively, with a maximum diameter.

FIG. 9 shows a relationship between a contact and separation motor 1003 and the contact state of the photosensitive drum 101 with the primary transfer roller 106 in the case where monochromatic images are formed on three A4-size sheets S. In FIG. 9, a bold line 1101*k* shows the contact state between the photosensitive drum 101*k* for the black k and the primary transfer roller 106*k* for the black k. A broken line 1102*k* shows a position, corresponding to the first sheet S, of the primary transfer roller 106*k* for the black k. A broken line 1103*k* shows a position, corresponding to the second sheet S, of the primary transfer roller 106*k* for the black k. A broken line 1104*k* shows a position, corresponding to the third sheet S, of the primary transfer roller 106*k* for the black k.

Here, maximum diameter positions of the cams 1001*k* and 1001*ymc* are deviated in phase from each other in the clockwise direction in FIG. 8. Further, a contact operation and a separation operation between the photosensitive drum 101 and the primary transfer roller 106 are performed by rotating the contact and separation motor 1003 under control by the drive controller 116 driven under control by the CPU 115*a*.

When the state changes from the stand-by state to the monochromatic contact state, in the stand-by state of part (a) of FIG. 8, the contact and separation motor 1003 rotates each of the cams 1001*ymc* and 1001*k* in the clockwise direction in part (a) of FIG. 8. By this, the cam 1001*k* starts pressing of the pressing member 1002*k* and presses the pressing member 1002*k* with the maximum radius thereof, so that the monochromatic contact state of part (b) of FIG. 8 in which the photosensitive drum 101*k* and the primary transfer roller 106*k* are in contact with each other is formed.

Further, when the state changes from the monochromatic contact surface to the full-color contact state, in the monochromatic contact state of part (b) of FIG. 8, the contact and separation motor 1003 further rotates each of the cams 1001*ymc* and 1001*k* in the clockwise direction in part (b) of FIG. 8. By this, the cams 1001*ymc* start pressing of the pressing members 1002*ymc*. Thus, the cams 1002*ymc* press the pressing members 1002*ymc* with the maximum radius thereof, so that the full-color contact state of part (c) of FIG. 8, in which all the photosensitive drums 101 and all the primary transfer rollers 106 are in contact with each other, is formed.

Further, when the state changes from the full-color contact state to the monochromatic contact state, in the full-color contact state of part (c) of FIG. 8, the contact and separation motor 1003 rotates each of the cams 1001*ymc* and 1001*k* in the counterclockwise direction in part (c) of FIG. 8. By this, the cams 1001*ymc* release pressing of the pressing members 1002*ymc* and release the pressing members 1002*ymc* thereof, so that the monochromatic contact state of part (b) of FIG. 8, in which the photosensitive drums 101*y*, 100*m* and 100*c* and the primary transfer rollers 106*y*, 106*m* and 106*c* are separated from each other, is formed.

Further, when the state changes from the mechanism contact state to the stand-by state, in the monochromatic contact state of part (b) of FIG. 8, the contact and separation motor 1003 further rotates each of the cams 1001*ymc* and 1001*k* in the counterclockwise direction in part (b) of FIG. 8. By this, the cam 1001*k* releases pressing of the pressing member 1002*k*, so that the monochromatic contact state of part (a) of FIG. 8 in which the photosensitive drum 101*k* and the primary transfer roller 106*k* are separated from each other is formed.

From FIG. 9, in the case where an all separation position is established in 0 step in the number of steps of the contact and separation motor 1003, in a 400-th step, the primary transfer roller 106*k* and the photosensitive drum 101*k* are in contact with each other. Further, in an 800-th step, drive of the contact and separation motor 1003 is stopped, so that the monochromatic contact state is maintained.

Thus, by controlling the contact and separation motor 1003, the contact state and the separated state between the primary transfer roller 106 and the photosensitive drum 101 can be controlled.

<Operation of Image Forming Apparatus>

A specific operation of the image forming apparatus according to the embodiment 2 will be specifically described with reference to FIG. 9.

The operation of the image forming apparatus according to this embodiment is the same as the operation of the image forming apparatus shown in FIG. 5, and therefore will be omitted from detailed description. Further, in this embodiment, description will be mode using the reference numerals or symbols shown in FIGS. 1 to 3.

In this embodiment, the contact timing is delayed depending on the length of the leading end non-image region of the first sheet S during the image forming operation or the separation timing is hastened depending on the length of the trailing end non-image region of the final sheet S during the image forming operation.

Specifically, the CPU 115*a* acquires a rotation time by dividing, by a rotational speed of the photosensitive drum 101, a length of an outer periphery of the photosensitive drum 101 from the laser irradiation position to a contact position of the photosensitive drum 101 with the primary transfer roller 106 with respect to the rotational direction of the photosensitive drum 101. Further, the CPU 115*a* acquires an addition delay time by adding the acquired rotation time and the contact delay time acquired similarly as in the above-described embodiment 1. Then, the CPU 115*a* causes the contact and separation motor 1003 to start drive after a lapse of the acquired addition delay time from output timing, of the TOP signal for the first sheet, when the laser irradiation of the photosensitive drum 101*y* from the laser scanner 103 is capable of being started. Incidentally, the CPU 115*a* is capable of acquiring the contact delay time similarly as in the embodiment 1.

By this, as shown in FIG. 9, the contact start timing between the photosensitive drum 101 and the primary transfer roller 106 for each of the colors is delayed 0.5 sec longer than timing M11 in the case where the start of the driving operation is not delayed. Then, when the number of steps of the contact and separation motor 1003 becomes 400 steps, the primary transfer roller 106*k* contacts the intermediary transfer belt 107 toward the photosensitive drum 101*k*.

Further, the CPU 115*a* acquires a rotation time by dividing, by the rotational speed of the photosensitive drum 101, a length of an outer periphery of the photosensitive drum 101 from the laser irradiation position to a contact position of the photosensitive drum with the intermediary transfer belt 7 toward the primary transfer roller 106 with respect to the rotational direction. The rotation time is calculated in advance and stored in the ROM 115*b*, and the CPU 115*a* may read the rotation time from the ROM 115*b* as needed.

Further, the CPU 115*a* acquires an addition formation time by adding the rotation time to the image formation time similarly as in the embodiment 1. Then, the CPU 115*a* causes the contact and separation motor 1003 to start drive earlier, by a separation front-loaded time, than a lapse of the addition formation time from the output timing of the TOP signal for the final sheet. Incidentally, the CPU 115*a* is capable of acquiring the separation front-loaded time and the image formation time similarly as in the embodiment 1.

By this, as shown in FIG. 9, the separation start timing between the photosensitive drum 101 and the primary transfer roller 106 for each of the colors is 0.45 sec earlier than timing M12 in the case where the start of the separation operation is not hastened. Then, when the number of steps of the contact and separation motor 1003 becomes 400 steps, the primary transfer roller 106*k* is separated from the photosensitive drum 101*k*, and when the number of steps of the contact and separation motor 1003 becomes 0 step, the CPU 115*a* causes the contact and separation motor 1003 to stop the drive of the contact and separation motor 1003 and maintains the separated state.

The fog does not occur as long as the primary transfer roller 106*k* contacts the intermediary transfer belt 107 toward the photosensitive drum 101, and therefore, the leading end non-image region of the first sheet S and the trailing end non-image region of the third sheet S are fog non-occurrence regions. Accordingly, on the same surface of the sheet S, it is possible to create the fog non-occurrence region and the fog occurable region, so that in the case where the length of each of the leading end non-image region and the trailing end non-image region is 5 mm or more, the fog density can be detected from a difference in brightness L between these regions.

When progression of the detected fog density is monitored and an increase in fog density is detected, the CPU 115*a* discriminates that the primary transfer roller 106*k* for the black k approaches the end of the lifetime thereof and then notifies the user that the lifetime of the primary transfer roller 106*k* for the black k approaches the end thereof.

Thus, according to this embodiment, by controlling actuating timing of the contact and separation motor 1003, it is possible to detect the fog density in the image forming operation.

Further, in order to detect the fog density from the same surface of the sheet S, even on the sheet S providing a density difference such as brightness difference between the front and rear side, it is possible to accurately detect the fog density without generating the downtime such as a delay of the FPOT.

Incidentally, in this embodiment, the monochromatic contact position and the all separation positions are maintained, but the full-color contact positions may also be maintained.

Further, in this embodiment, a constitution in which a single primary transfer roller of a 4-cycle type is provided may also be employed.

In this embodiment, the fog non-occurrence region is formed in the non-image region of the sheet by carrying out control so that the primary transfer roller 106 does not act on the photosensitive drum 101. Further, the fog occurable region is formed in the non-image region of the sheet by carrying out control so that the primary transfer roller 106 acts on the photosensitive drum 101. Then on the basis of a difference in brightness between the fog non-occurrence region and the fog occurable region, the fog density is detected. By this, it is possible to accurately detect the fog density without generating the downtime.

Other Embodiments

An image forming apparatus according to another embodiment of the present invention will be described with reference to FIGS. 10 and 11.

First, in a modified embodiment as another embodiment of the present invention, as shown in FIG. 10, in the case where the length of the leading end non-image region or the trailing end non-image region with respect to the sheet feeding direction is less than the predetermined value, control such that a changing operation of the contact and separation timing is skipped may also be carried out.

In FIG. 10, steps performing the same operations as those of the portions shown in FIG. 5 are represented by the same reference numerals or symbols and will be omitted from description.

From FIG. 10, the CPU 115*a* acquires the length of the leading end non-image region for each of the colors in the case where the leading end non-image region of the first sheet S is detected (S1: YES). Then, the CPU 115*a* discriminates whether or not the shortest length of the lengths of the leading end non-image regions acquired for each of the colors is not less than the predetermined value (not less than the threshold) (S21).

In the case where the shortest length of the leading end non-image region lengths is not less than the predetermined value (S21: YES), the CPU 115*a* calculates the contact delay time from the preset feeding speed and the acquired shortest length of the leading end non-image region lengths for each other (S22).

Next, on the basis of the acquired contact delay time, the CPU 115*a* delays the start of the drive of the contact and separation motor 402 by the contact delay time (S23), and thereafter performs the operation of the step S5.

On the other hand, in the case where the shortest length of the leading end non-image regions of the sheets is less than the predetermined value (S21: NO), the CPU 115*a* skips operations from a step S21 to a step S23 and operations from the step 5 to the step S7.

Further, in the case where the trailing end non-image region of the sheet S is detected (S9: YES), the CPU 115*a* acquires the trailing end non-image region for each other. Further, the CPU 115*a* discriminates whether or not the shortest length of the acquired trailing end non-image region lengths for each color is not less than a predetermined value (not less than a threshold) (S31).

In the case where the shortest length of the trailing end non-image region lengths is not less than the predetermined value (S31: YES), the CPU 115*a* calculates the separation front-loaded time from the preset feeding speed and the acquired shortest length of the trailing end non-image region lengths for each other (S32).

Next, on the basis of the acquired separation front-loaded time, the CPU 115*a* hastens the start of the drive of the contact and separation motor 402 by the separation front-loaded time (S33), and thereafter carries out the operation of the step S13.

On the other hand, in the case where the shortest length of the trailing end non-image region lengths is less than the predetermined value (S31: NO), the CPU 115*a* ends the operation.

Then, an image forming apparatus according to a modified embodiment 2 as another embodiment of the present invention includes a color sensor 113 in a double-side (printing) feeding passage DP as shown in FIG. 11.

The present invention is not limited to the above-described embodiments, but can be variously modified within a range not departing from the scope of the present invention.

Specifically, in the embodiments 1 and 2 and other embodiments described above, the drive of the contact and separation motor may also be delayed by a contact delay time acquired using a length shorter than the leading end non-image region length. For example, in the case where the leading end non-image region length is 100 mm, the contact delay time may also be acquired using a length of 50 mm.

Further, in the embodiments 1 and 2 and other embodiments described above, in the case where there is a non-image region of 5 mm or more in length on an n-th sheet ($1<n<k$) between the first sheet and the final sheet (k-th sheet), the fog non-occurrence region may also be formed in the non-image region.

Further, in the embodiments 1 and 2 and other embodiments described above, the fog non-occurrence region was formed in both the leading end non-image region and the trailing end non-image region, but the fog non-occurrence region may also be formed in either one of the leading end non-image region and the trailing end non-image region.

Further, in the embodiments 1 and 2 and other embodiments described above, for example, a constitution in which in an image forming apparatus employing a jumping development, the development is controlled by a developing bias may also be used.

Further, in the embodiments 1 and 2 and other embodiments described above, the case where the sheets on which each of the leading end non-image region length and the trailing end non-image region length is less than the predetermined length are continued would be also considered. In such a case, values of the brightness L in the fog non-occurrence regions are substantially the same if the sheets S of the same kind are used, and therefore, the fog density may also be detected on the basis of the brightness L in the fog non-occurrence region on another page or the brightness L of the accumulated sheets S of the same kind. It would be considered that whether or not the sheets S used are of the same kind is discriminated by a means in which a sensor for reading the kind of the sheets S is provided upstream of the transfer means and a method in which the sheets S are discriminated as the sheets of the same kind as long as there is no open/close operation of a sheet feeding cassette C, and the like means or method.

According to the above-described embodiments, the fog density can be accurately detected without generating the downtime.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-134295 filed on Jul. 22, 2019, which is hereby incorporated by reference herein in its entirety.

What is claimed is:

1. An image forming apparatus, comprising:

an image bearing member on which an electrostatic latent image is formed;

a developing member configured to develop the electrostatic latent image, formed on said image bearing member, into a toner image;

a controller configured to carry out switching control between a first state in which said developing member is caused to act on said image bearing member such that a first non-image region is formed on a recording material and a second state in which said developing member is not caused to act on said image bearing member such that a second non-image region different from the first non-image region is formed on the recording material;

a transfer member configured to transfer the toner image from said image bearing member onto the recording material; and a detector configured to detect characteristics of a surface of the recording material carrying the toner image transferred by said transfer member, said detector being configured to detect the characteristics in the first non-image region and the second non-image region, wherein said controller is configured to acquire a fog density on the basis of a difference between (i) a first input related to the characteristics detected in the first non-image region by said detector and (ii) a second input related to the characteristics detected in the second non-image region by said detector.

2. An image forming apparatus according to claim 1, wherein said controller carries out the switching control of the first state in which said developing member is contacted to said image bearing member and the second state in which said developing member is separated from said image bearing member.

3. An image forming apparatus according to claim 1, wherein said controller discriminates a lifetime of said developing member.

4. An image forming apparatus according to claim 1, wherein said controller is configured to acquire the fog density when a length of the second non-image region with respect to a movement direction of the recording material is equal to or longer than a threshold.

5. An image forming apparatus according to claim 1, wherein said controller is configured to carry out the switching control such that the first non-image region and the second non-image region are formed on the same surface of the recording material.

6. An image forming apparatus according to claim 1, wherein said controller is configured to form the first non-image region in at least one of a leading end region and a trailing end region of the recording material with respect to a movement direction of the recording material.

7. An image forming apparatus according to claim 6, wherein when images are formed on a plurality of recording materials, said controller is configured to form the first non-image region in at least one of the leading end region of a first recording material and the trailing end region of a final recording material.

8. An image forming apparatus according to claim 1, wherein the characteristics relate to brightness.

* * * * *